US005660084A

United States Patent [19]

Bettenhausen

[11] Patent Number: 5,660,084

[45] Date of Patent: Aug. 26, 1997

[54] POSITIONING APPARATUS FOR CARRIAGE ON A SUPPORT COLUMN

[76] Inventor: Roger V. Bettenhausen, 5 Lakewood Dr., Columbus, Nebr. 68601

[21] Appl. No.: 678,184

[22] Filed: Jul. 11, 1996

Related U.S. Application Data

[62] Division of Ser. No. 498,180, Jul. 5, 1995, abandoned.

[51] Int. Cl.[6] ..... B60S 9/02

[52] U.S. Cl. ..... 74/540; 53/556; 53/219; 74/545; 74/594.1; 254/264

[58] Field of Search ..... 53/587, 588, 210, 53/211, 556, 219; 74/29, 31, 46, 89.17, 540, 545, 411.5, 600, 625, 594.1, 813 L; 254/264; 242/395; 284/427, 97

[56] References Cited

U.S. PATENT DOCUMENTS

| | | | |
|---|---|---|---|
| 2,499,005 | 2/1950 | Sellers | 254/97 |
| 3,921,958 | 11/1975 | Brockelsby et al. | 254/97 |
| 4,510,980 | 4/1985 | Bartlett | 144/1 C |
| 4,845,920 | 7/1989 | Lancaster | 53/587 |
| 4,848,735 | 7/1989 | Pittman | 254/97 |
| 4,978,104 | 12/1990 | Gipson, Jr. | 254/97 |
| 5,192,122 | 3/1993 | Hill | 312/267 |
| 5,353,690 | 10/1994 | Shin | 74/625 |
| 5,421,555 | 6/1995 | Sims | 254/97 |

FOREIGN PATENT DOCUMENTS

| | | | |
|---|---|---|---|
| 2810124 | 9/1978 | Germany | 53/556 |
| 52-17991 | 10/1977 | Japan | 53/556 |
| 3-29715 | 2/1991 | Japan | 53/556 |

*Primary Examiner*—Daniel W. Howell
*Assistant Examiner*—Christopher Kirkman
*Attorney, Agent, or Firm*—Emrich & Dithmar

[57] ABSTRACT

Apparatus for tightly wrapping a package such as disposed on a pallet in a thin film such as for shipping or storage includes a rotating deck adapted to receive the pallet and package to be wrapped. The deck is directly coupled to and supported by a gear box driven by an electric motor. The apparatus further includes a film wrap supply in the form of a roll which lets out the film for wrapping around the package as the deck and package rotate. A manually adjustable tensioner allows for adjusting the stretch of the wrapping film on the package, while the film wrap supply may be adjusted vertically to permit wrapping the package over its entire vertical dimension regardless of the width of the roll of film wrap. A foot control allows an operator of the apparatus to rotate the deck and the package being wrapped while vertically moving the film wrap supply roll-to fully enclose the package within the wrapping film.

10 Claims, 6 Drawing Sheets

POSITIONING APPARATUS FOR CARRIAGE ON A SUPPORT COLUMN

This is a division of application Ser. No. 087/498,180, filed Jul. 5, 1995, now abandoned.

FIELD OF THE INVENTION

This invention relates generally to the field of packaging and is particularly directed to apparatus for wrapping an object within a thin film for enclosing it and protecting the object such as during shipment or storage.

BACKGROUND OF THE INVENTION

For shipment or storage, packages are frequently wrapped with a plastic film material so as to provide a strong and protective layer about the package. By "package" is meant here any object or article, or collection of objects or articles, which are to be wrapped such as for shipment or storage. One common approach is to position the package on a rotating platform and dispense the plastic film in engagement with the package as the package is rotated. The plastic film dispenser may be either hand-held or attached to the package wrapping apparatus.

Referring to FIGS. 1*a* and 1*b*, there are respectively shown partially cutaway and partially in phantom top plan and side elevation views of a typical prior art package wrapping apparatus 100. The wrapping apparatus 100 includes a rotating deck 102 which is disposed upon and supported by a plurality of rollers 104*a*–104*d*. The package to be wrapped is disposed on the rotating deck 102 which may also support a pallet on which the package is disposed for ease of handling the package. Each of these support rollers 104*a*–104*d* is attached to and supported by a respective bracket 106*a*–106*d*. A center, lower portion of the rotating deck 102 is positioned on and supported by a combination of a support shaft 112, bearings 116 and a race 114. The combination of rollers 104*a*–104*d* and bearings 116 allow for the free rotation of deck 102 about a generally vertical axis through shaft 112. A rotary drive arrangement 108 such as including an electric motor is typically coupled to the support shaft 112 by means of sprockets or pulleys and a chain, belt, or other suitable linkage 110.

One disadvantage of the prior art package wrapping apparatus 100 is that the tension of the wrapping material is difficult to control and thus the tightness of the wrap about the package is generally nonuniform. In addition, the rotational drive arrangement does not provide positive control over the rotating package thus necessitating the use of a brake mechanism to slow down and stop the rotating deck and package combination. Finally, the rollers 104*a*–104*d* disposed about and engaging a lower portion of the rotating deck 102 must be precisely aligned relative to one another as well as to the deck and substantially increase the cost and complexity of the wrapping apparatus.

The present invention addresses the aforementioned limitations of the prior art by providing a package wrapping apparatus which provides a direct drive for a rotating deck supporting the package which simplifies the apparatus and provides improved control of the rotating package and deck. The apparatus includes a film wrap dispenser which may be adjusted vertically to permit the entire package to be wrapped by a narrow roll of film wrap, and further includes a manually adjustable tensioner which allows for adjusting the stretch of the film wrap about the package.

OBJECTS AND SUMMARY OF THE INVENTION

Accordingly, it is an object of the present invention to provide apparatus for wrapping an object such as disposed on a pallet with a thin film of wrapping material for shipment or storage.

It is another object of the present invention to permit a single worker to safely and quickly wrap a package tightly and securely in a thin film using a roll of thin film wrapping material.

Yet another object of the present invention is to provide pallet wrapping apparatus which is of simple construction, capable of operation by a single worker, and economical to operate and maintain.

Apparatus for wrapping a package in a thin film, said apparatus comprising: a base; a generally flat deck disposed on the base for supporting the package; a motor and transmission combination mounted to the base and directly coupled to a lower, center portion of the deck for rotationally displacing the deck and a package thereon about a generally vertical axis; a wrapping film roll dispenser; a moveable carriage coupled to the base for supporting and allowing for vertical displacement of said film dispenser as the film is wrapped around a rotating package disposed on the deck to permit the film to be wrapped around the entire package.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

DETAILED DESCRIPTION OF THE PREFERRED EMBODIMENT

Figure 1A:
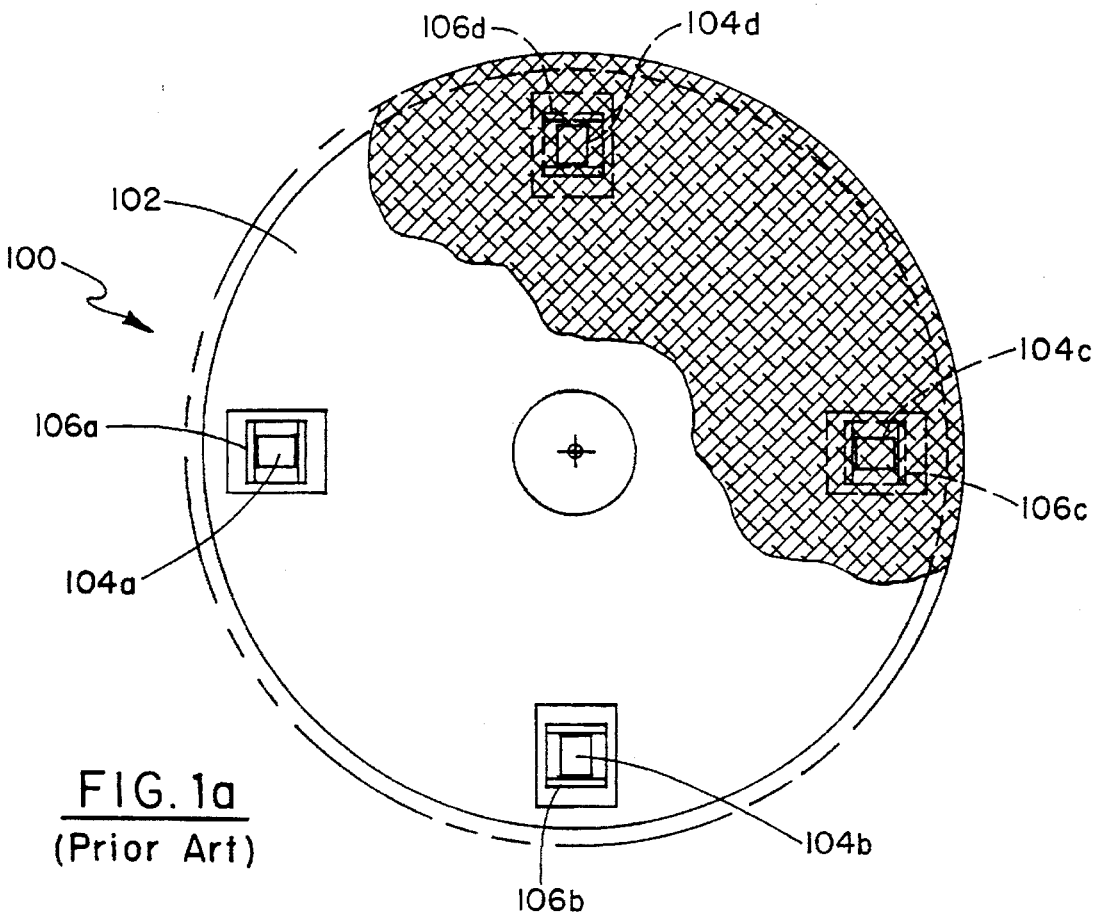
FIG. 1a (Prior Art)
FIGS. 1*a* and 1*b* are respectively top plan and side elevation views shown partially in phantom and partially cutaway of a prior art package wrapping apparatus of the rotating type.
Figure 1B:
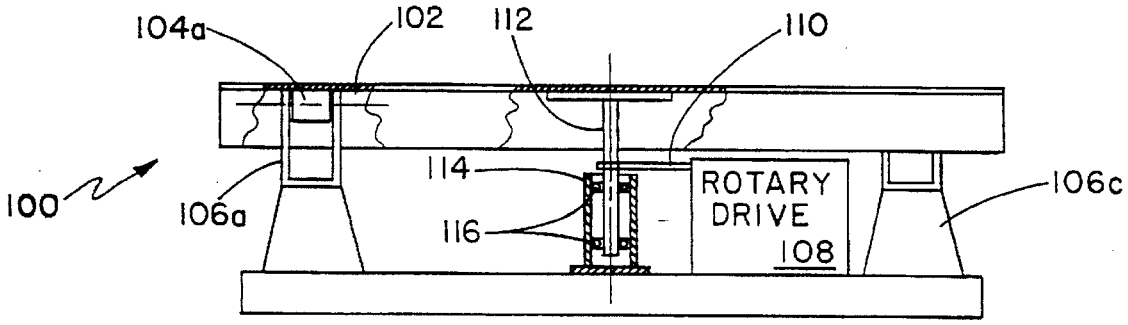
FIG. 1b (Prior Art)
Figure 2:
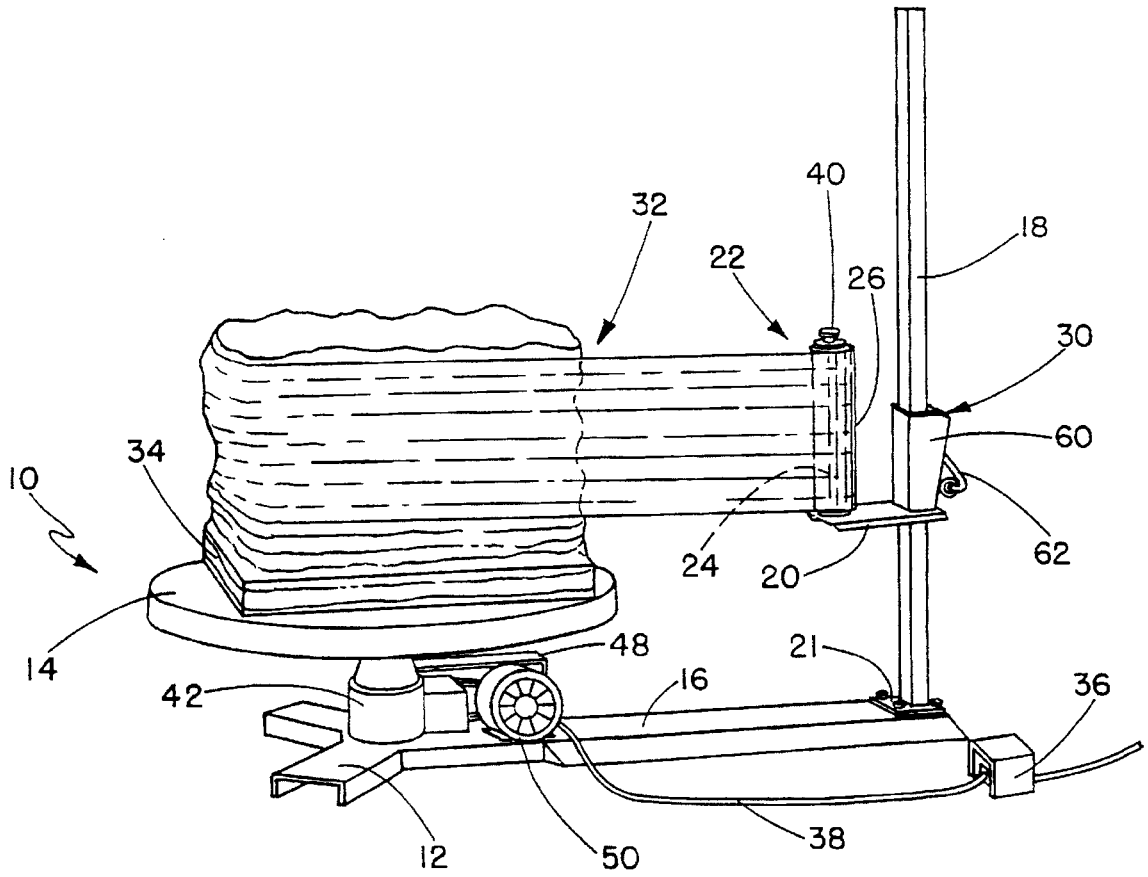
FIG. 2 is a perspective view of a package wrapping collection of objects disposed on a pallet for wrapping in a thin apparatus in accordance with the present invention showing a film wrap.
Figure 3:
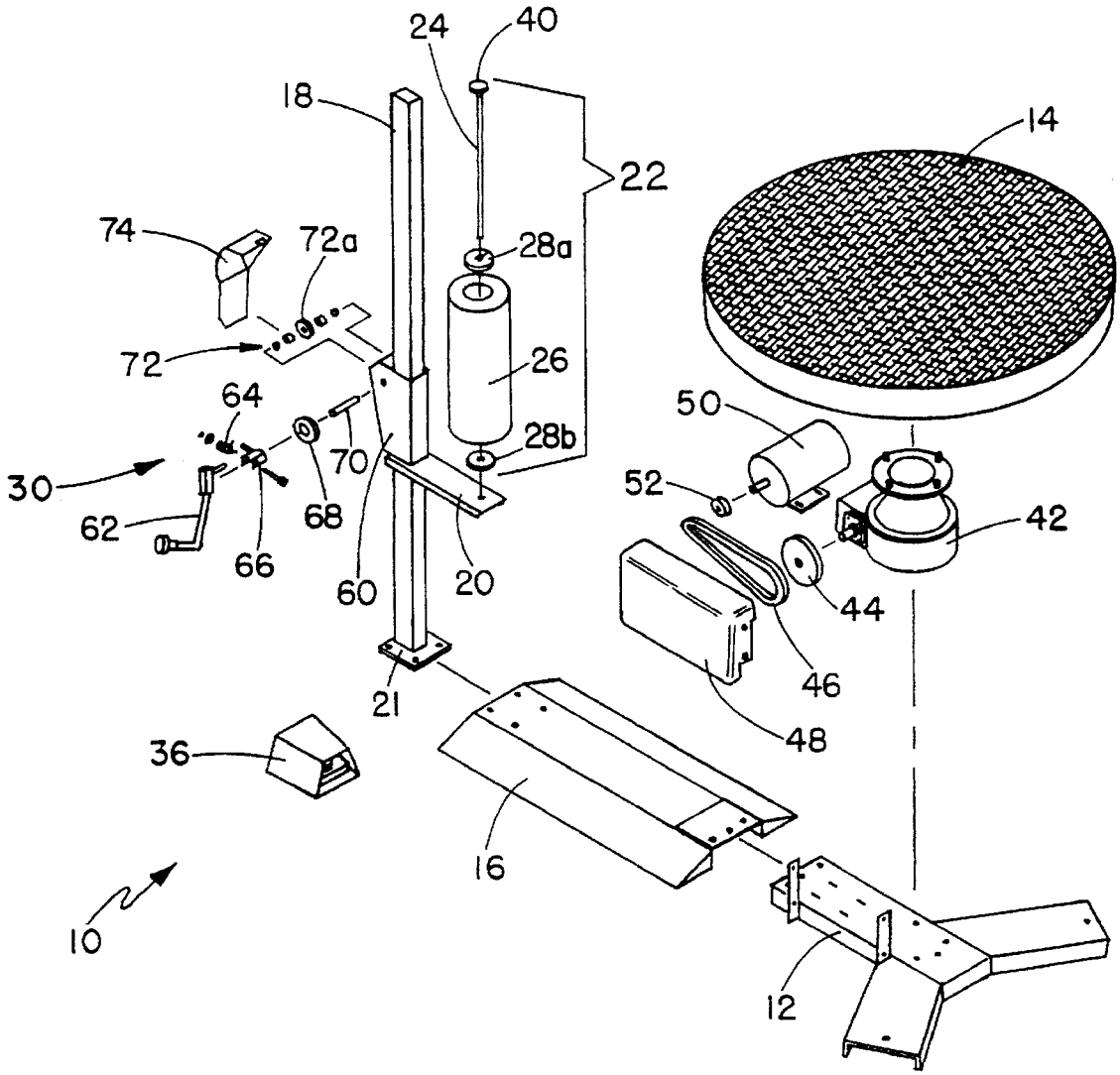
FIG. 3 is an exploded perspective view of the package wrapping apparatus of FIG. 2.

Referring to FIG. 2, there is shown a perspective view of a package wrapping apparatus 10 in accordance with the principles of the present invention. FIG. 3 is an exploded perspective view of the package wrapping apparatus 10 shown in FIG. 2.

Package wrapping apparatus 10 includes a base 12 adapted for positioning on a flat support surface and further includes a rotating deck 14 adapted to receive and support a package 32. In FIG. 2, package 32 is shown disposed on a pallet 34 for ease of handling such as by means of a forklift.

Figure 5:
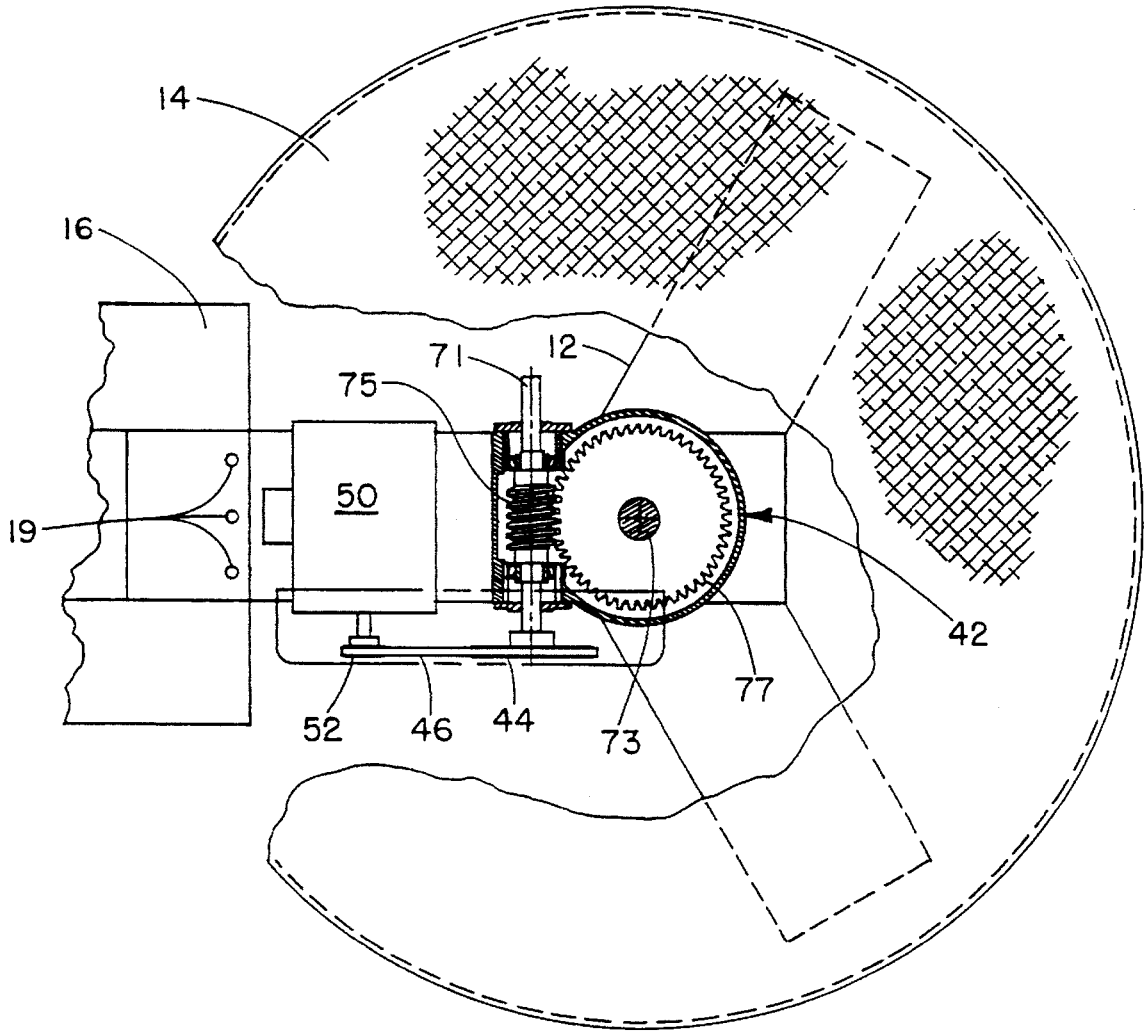
FIG. 5 is a partially cut away partial top plan view of the package wrapping apparatus of the present invention shown partially in phantom illustrating additional details of the rotational drive arrangement.

Attached to the base 12 and also disposed on the support surface is a base extension 16. Conventional coupling means such as nut and bolt combinations 19 such as shown in FIG. 5 may be used to connect base 12 with base extension 16. Attached to an upper surface of the base extension 16 by conventional means such as nut and bolt combinations (which are not shown for simplicity) is a vertical support column 18. A mounting bracket 21 disposed on the lower end of the support column 18 facilitates attaching the support column to the base extension 16. Disposed on the vertical support column 18 is the combination of a film wrap supply and tensioner 22 and a film wrap height positioner 30 which are described in detail below.

Figure 4:
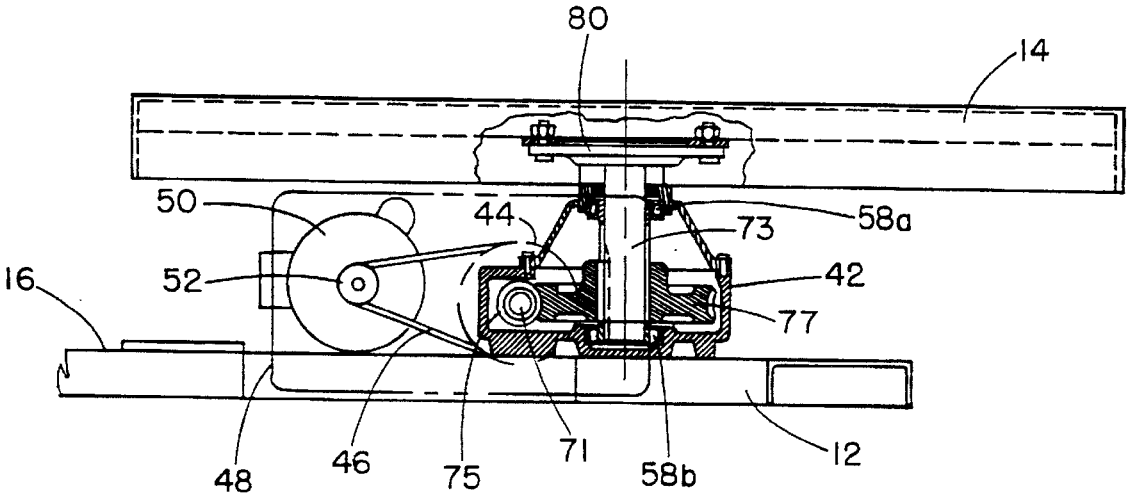
FIG. 4 is a partially cutaway side elevation view shown partially in phantom of the rotational drive arrangement for the package supporting deck in the package wrapping apparatus of the present invention.

With reference to FIGS. 2 and 3, as well as to FIGS. 4 and 5 which are respectively partially cutaway side elevation and top plan views of the rotating package positioning and support portion of the package wrapping apparatus 10, the drive arrangement for rotationally displacing the package 32 disposed on the rotating deck 14 will now be described. Fixedly mounted to an upper surface of base 12 is the combination of an electric motor 50 and a gear box 42. Electric motor 50 and gear box 42 are coupled by means of the combination of first and second pulleys 44 and 52 and an endless drive belt 46. Rotation of the output shaft of motor 50 causes a corresponding rotation of an input shaft 71 of gear box 42. A cover 48 is disposed over the pulley and endless drive belt combination. Disposed on input shaft 71 is a threaded portion 75 which is positioned so as to engage the teeth of a sprocket 77 so as to form a worm gear within gear box 42. Inserted through and fixedly attached to sprocket 77 is a generally vertically oriented output shaft 73. The upper end of output shaft 73 is coupled to a mounting bracket 80 which, in turn, is securely attached to a lower surface of the rotating deck 14. Upper and lower bearings **58*a* and 58*b* and suitable inner and outer races permit free rotation of the output shaft 73 and deck 14 about a generally vertically axis extending through the center of the output shaft. Directly connecting the rotating deck 14 to and supporting the rotating deck by means of the rotational drive unit including motor 50 and gear box 42** eliminates the outer rollers required in the prior art to support the rotating deck and allows for improved control over displacement of the deck, particularly in eliminating the need for a braking mechanism for bringing the rotating deck to a stop.

The electric motor 50 used in the present invention may be of conventional design and operation and is thus provided with an electrical lead 38 for connecting to a source of electrical power. A foot switch 36 is coupled to the electrical lead 38 for applying electrical power to and removing power from motor 50 in starting and stopping rotation of the rotating deck 14 and package 32 disposed thereon. Use of foot switch 36 frees the hands of an operator of the package wrapping apparatus 10 to perform other operations such as stabilizing the package on the rotating deck 14 or manipulating the film wrap as it is unrolled onto the package.

Referring to FIGS. 3 and **6*a*, 6*b*, the configuration and operation of the film wrap height positioner 30 and tensioner 22 will now be described. The film wrap height positioner 30 includes a film wrap carriage 60 disposed on the vertical support column 18. Disposed on one surface of the vertical support column 18 is a gear rack 76. Disposed on the film wrap carriage 60 is the combination of a crank 62, a torsion spring 64, a coupler 66, a sprocket 68, and a rotatable shaft 70. Shaft 70 extends between facing lateral portions of the film wrap carriage 60, with bushings and spacers 72 and a spur gear 72*a* disposed on shaft 70 between the facing lateral portions of the film wrap carriage 60. The spring-loaded crank 62 is coupled to shaft 70 by means of coupler 66. Rotation of crank 62 causes a corresponding rotation of shaft 70 and spur gear 72*a*. Thus, when crank 62 is rotated clockwise as viewed in FIG. 6*a*, the film wrap carriage 60 will be displaced upwardly along the vertical support column 18 because of the engagement of the rotating spur gear 72*a* with gear rack 76. Similarly, the rotation of crank 62 in a counter clockwise direction will result in a lowering of the film wrap carriage 60 along the vertical support column 18**.

Figure 6A:
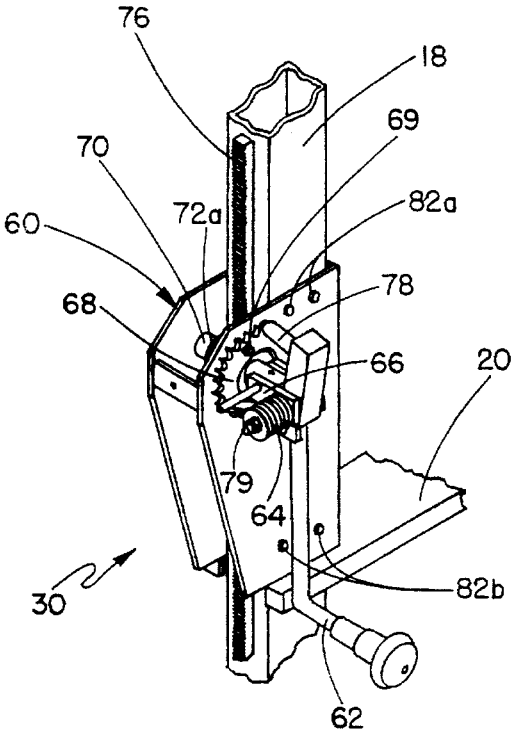
FIGS. 6*a* and 6*b* are perspective views of a film wrap height positioner for use in the package wrapping apparatus of the present invention respectively illustrating the film wrap height positioner in the unlocked and locked positions.
Figure 6B:
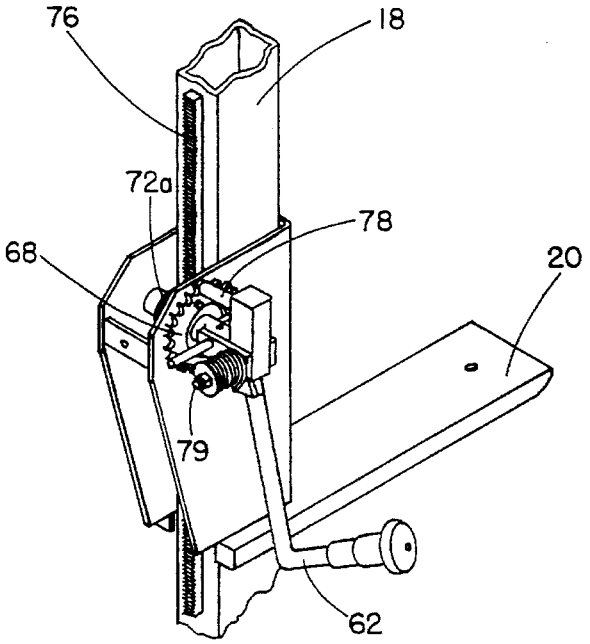

Sprocket 68 is fixedly attached to the film wrap carriage 60 by means of one or more coupling bolts 69. Extending from a proximal end of crank 62 is a lock pin 78. Crank 62 is free to pivot about a pivot pin 79 inserted through a distal end portion of coupler 66. With crank 62 displaced inwardly toward the film wrap carriage 60 as shown in FIG. **6*a*, lock pin 78 is displaced away from sprocket 68 and the combination of crank 62 and spur gear 72*a* is freely rotatable about the longitudinal axis of shaft 70 to allow for displacement of the film wrap carriage 70 along vertical support column 18. When crank 62 is pivotally displaced outwardly about pivot pin 79 as shown in FIG. 6*b*, the distal end of lock pin 78 is inserted between adjacent teeth within sprocket 68 to prevent rotation of the combination of crank 62, shaft 70 and spur gear 72*a* to prevent displacement of the film wrap carriage 60 on the vertical support column 18. Torsion spring 64 disposed about pivot pin 79 and engaging crank 62 urges the crank outwardly from the film wrap carriage 60 as shown in FIG. 6*b* to maintain lock pin 78 in engagement with sprocket 68. In this manner, the film wrap carriage 60 is maintained in the locked position to prevent movement of the film wrap carriage on the vertical support column 18 until crank 62 is urged inwardly to the position shown in FIG. 6*a* by overcoming the force of torsion spring 64. When crank 62 is displaced inwardly as shown in FIG. 6*a*, crank 62 may be rotationally displaced for moving the film wrap carriage 60 either up or down along the vertical support column 18. Polyethylene contact buttons 82*a* and 82*b* comprised of an ultra-high molecular weight material are inserted through the film wrap carriage 60 and engage opposing lateral surfaces of the vertical support column 18 to facilitate sliding displacement of the film wrap carriage along the vertical support column. A removable cover 74 is attached to the film wrap carriage 60 for covering the spur gear 72 as it engages gear rack 76** for safety reasons.

Attached to and extending from the film wrap carriage 60 is a support bracket 20. Support bracket 20 is securely coupled to the film wrap carriage 60 by conventional means such as weldments. Attached to a distal end of support bracket 20 is a film wrap supply and tensioner mechanism 22. The supply and tensioner mechanism 22 is adapted to support a film wrap roll 26 and includes upper and lower washers **28*a* and 28*b* and a roll support shaft 24 inserted through the film wrap roll. Support shaft 24 is also inserted through upper and lower washers 28*a*, 28*b* which are disposed on respective upper and lower ends of the film wrap roll 26. Disposed on the upper end of the support shaft 24 is a tension control knob 40 which allows for rotational displacement of the support shaft for adjusting the tension applied to the film wrap roll 26. In this manner, the extent to which the film wrap removed from roll 26 is stretched as it is wrapped around a rotating package may be precisely controlled by either tightening or loosening the roll support shaft 24**.

There has thus been shown apparatus for wrapping a package disposed on a rotating platform. The platform is rotated by means of a direct drive arrangement including an electric motor and gear box which is coupled directly to and provides support for the rotating platform. The electric motor and gear box combination is mounted to a fixed base.

Also coupled to the fixed base is a generally vertical support column to which is mounted a film wrap carriage with height adjustment and a film wrap supply and tensioner mechanism. The film wrap supply and tensioner mechanism includes a roll of film wrap which is wrapped around the package on the platform as the platform and package combination is rotationally displaced. The extent of stretch of the film, or the tension applied to the film as it is removed from the film wrap supply, may be easily and precisely adjusted over a wide range of values. The height of the film wrap carriage may be adjusted along the length of the vertical support column to permit virtually any size package to be enclosed in the film wrap regardless of the width of the film wrap roll. The film wrap carriage may be locked in position on the vertical support column to prevent vertical displacement of the film wrap supply on the support column for operator safety. The package wrapping apparatus may be operated by a single worker using a foot control for rotating the package support deck while freeing the operator's hands to control wrapping of the package in the film wrap.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. Apparatus for moving a carriage along a generally linear support column, said apparatus comprising:

a rack attached to the support column;

a rotatable shaft coupled to said carriage;

a hand operated crank pivotally coupled to said shaft, said crank movable between first and second positions on said carriage;

a spur gear attached to said shaft and responsive to rotation of said crank, said spur gear further engaging said rack for displacing the carriage along the support column when said crank is rotationally displaced;

biasing means for urging said crank to said first position;

stop means mounted to said carriage for providing a plurality of stop members disposed about the periphery thereof; and locking means attached to said crank for engaging a stop member when said crank is in said first position for preventing rotation of said crank and spur gear and displacement of the carriage on the support column, wherein said locking means disengages said stop member when a force exerted by said biasing means on said crank is overcome and said crank is moved to said second position.

2. The apparatus of claim 1 wherein said first position of said crank is farther from said carriage than said second position requiring said crank to be displaced inwardly toward said carriage to disengage said locking means from said stop member for displacing the carriage along the support column.

3. The apparatus of claim 2 further comprising a pivot pin and coupler combination for connecting said crank to said rotatable shaft, wherein said crank is connected to said pivot pin for pivoting between said first and second positions.

4. The apparatus of claim 3 wherein said crank and said locking means are on opposed sides of said pivot pin.

5. The apparatus of claim 4 wherein said biasing means is mounted to said pivot pin for urging said crank and said locking means in a first direction of rotation about said pivot pin toward said first position.

6. The apparatus of claim 5 wherein said biasing means comprises a spring.

7. The apparatus of claim 1 wherein said stop means comprises a sprocket fixedly mounted to said carriage and including a plurality of spaced teeth about the periphery thereof forming said stop members.

8. The apparatus of claim 7 wherein said locking means comprises a pin attached to an end of said crank for engaging a tooth of said fixed sprocket when said crank is in said first position.

9. The apparatus of claim 7 further comprising a rotatable shaft coupled to said carriage and attaching said spur gear to said crank, wherein said rotatable shaft extends through a center portion of said sprocket.

10. Apparatus for moving a carriage having a slot therein along a generally linear support column, wherein said support column is disposed in the slot of said carriage, said apparatus comprising:

a rack attached to the support column;

a spur gear disposed in the slot of the carriage and engaging said rack;

a rotatable shaft coupled to said carriage and extending across the slot therein, said rotatable shaft further coupled to said spur gear;

crank means coupled to said shaft for rotatably displacing said spur gear and moving the carriage in a linear manner on the support column;

pivot mounting means for attaching said crank means to said shaft, wherein said crank means is movable between first and second positions;

biasing means coupled to said pivot mounting means for urging said crank means to said first position, wherein said crank means is movable to said second position by applying an inwardly directed force toward said carriage for overcoming a force exerted by said biasing means;

a sprocket fixedly mounted to said carriage and having a plurality of teeth disposed about the periphery thereof; and a locking pin attached to said crank means for engaging one or more teeth of said sprocket when said crank means is in said first position for preventing rotation of said crank means and displacement of the carriage on the support column, wherein said locking pin is disengaged from said one or more teeth when said crank means is moved to said second position permitting movement of the carriage on the support column.

* * * * *

UNITED STATES PATENT AND TRADEMARK OFFICE

CERTIFICATE OF CORRECTION

PATENT NO. : 5,660,084

DATED : AUGUST 26, 1997

INVENTOR(S) : ROGER V. BETTENHAUSEN

It is certified that error appears in the above-indentified patent and that said Letters Patent is hereby corrected as shown below:

Column 2, delete lines 34-37 and insert the following:

FIG. 2 is a perspective view of a package wrapping apparatus in accordance with the present invention showing a collection of objects disposed on a pallet for wrapping in a thin film wrap;

Signed and Sealed this

Second Day of December, 1997

*Attest:*

*Attesting Officer*

Bruce Lehman

BRUCE LEHMAN

*Commissioner of Patents and Trademarks*